US012186618B2

(12) United States Patent
Renz

(10) Patent No.: US 12,186,618 B2
(45) Date of Patent: Jan. 7, 2025

(54) EXERCISE PROP

(71) Applicant: Diane G. Renz, San Antonio, TX (US)

(72) Inventor: Diane G. Renz, San Antonio, TX (US)

( * ) Notice: Subject to any disclaimer, the term of this patent is extended or adjusted under 35 U.S.C. 154(b) by 162 days.

(21) Appl. No.: 17/899,431

(22) Filed: Aug. 30, 2022

(65) Prior Publication Data

US 2023/0061810 A1 Mar. 2, 2023

Related U.S. Application Data

(60) Provisional application No. 63/239,088, filed on Aug. 31, 2021.

(51) Int. Cl.

| | |
|---|---|
| ***A63B 21/00*** | (2006.01) |
| ***A63B 21/002*** | (2006.01) |
| ***D04C 1/02*** | (2006.01) |
| ***D04C 1/12*** | (2006.01) |

(52) U.S. Cl.

CPC .... *A63B 21/4035* (2015.10); *A63B 21/00043* (2013.01); *A63B 21/0023* (2013.01); *D04C 1/02* (2013.01); *D04C 1/12* (2013.01); *D10B 2507/00* (2013.01)

(58) Field of Classification Search

CPC .... D04C 1/00; D04C 1/02; D04C 1/12; A63B 21/00043; A63B 21/4035; A01K 15/026

See application file for complete search history.

(56) References Cited

U.S. PATENT DOCUMENTS

| | | | | |
|---|---|---|---|---|
| 2,700,317 | A * | 1/1955 | Lilienfeld | B64D 17/00 87/8 |
| 3,977,796 | A | 8/1976 | Gillespie et al. | |
| 4,924,811 | A | 5/1990 | Axelrod | |
| D316,941 | S | 5/1991 | Ruiz | |
| D381,545 | S | 7/1997 | Muttick et al. | |
| D533,308 | S | 12/2006 | Kovac | |
| 7,175,574 | B2 | 2/2007 | Carmel et al. | |
| 7,823,542 | B2 * | 11/2010 | Freeman | D04C 1/12 119/709 |
| 8,083,652 | B2 | 12/2011 | Brody et al. | |
| 8,454,484 | B2 | 6/2013 | Keen et al. | |
| 8,715,140 | B1 * | 5/2014 | Gertz | A63B 9/00 482/90 |
| 10,335,630 | B2 | 7/2019 | Buniak | |
| 10,406,396 | B2 | 9/2019 | Hauptmann | |
| 10,441,836 | B1 | 10/2019 | Fairhurst | |
| D926,444 | S * | 8/2021 | Shoemaker | D2/880 |

(Continued)

FOREIGN PATENT DOCUMENTS

| | | | | |
|---|---|---|---|---|
| DE | 202015000274 U1 * | 7/2015 | | A63B 21/0442 |
| JP | 3203143 U * | 3/2016 | | |

(Continued)

OTHER PUBLICATIONS

Photo of "FLETCHER" towel, manufacturer/seller unknown, on sale least as early as Jul. 2020.

*Primary Examiner* — Shaun R Hurley

(74) *Attorney, Agent, or Firm* — Douglas B Teaney; Cardinal Law Group

(57) ABSTRACT

An exercise prop for use in the performance of floor-based exercises such as Pilates and isometric exercises is provided. The exercise prop includes a braided body having a looped handgrip at each end. A method for fabricating an exercise prop is also provided.

12 Claims, 11 Drawing Sheets

(56) References Cited

U.S. PATENT DOCUMENTS

| | | | | |
|---|---|---|---|---|
| 12,037,724 | B2 * | 7/2024 | David | A63B 5/20 |
| 2004/0204302 | A1 | 10/2004 | Flynn | |
| 2006/0073954 | A1 | 4/2006 | Block et al. | |
| 2014/0228183 | A1 | 8/2014 | Falconi et al. | |

FOREIGN PATENT DOCUMENTS

| | | |
|---|---|---|
| KR | 101933518 | 12/2018 |
| TW | M247233 | 10/2004 |

* cited by examiner

EXERCISE PROP

This application claims priority under 35 USC 119(e)(1) of the filing date of provisional application U.S. Ser. No. 63/239,088, filed 31 Aug. 2021, the complete contents of which are hereby expressly incorporated by reference in their entirety.

TECHNICAL FIELD

The present invention relates to the field of exercise props and related equipment, such as may be used by individuals performing various floor exercises, such as Pilates-type exercise programs, isometric exercise programs, and the like.

BACKGROUND OF THE INVENTION

Exercise props, for use in floor-based exercises, such as Pilates and isometric exercises, are known. Typically, such props are in the form of a simple basic towel.

One such towel is known as the Fletcher towel, which is fabricated as a simple braided structure, having a basic knot at each end to hold the three strips together in a braided form, with a loose web or tail at each end.

However, such a structure may be difficult to maintain a grip on, for persons who may have physical challenges which result in reduced capacity to maintain a grip on a plain towel end.

It would be desirable to provide an improved exercise prop for use in such exercises, which facilitates use by individuals who may have challenges in maintaining a hand grip.

SUMMARY OF THE INVENTION

An embodiment of the invention comprises an exercise prop. A body has first and second ends. A first handgrip is disposed at the first end, a second handgrip is disposed at the second end. The body comprises a braided structure, the first and second handgrips comprising extensions of the braided structure.

In an embodiment of the invention, the braided structure comprises three intertwined strips. In an embodiment of the invention, two of the three strips has a first length and one of the strips has a second length different from the first length. In an embodiment of the invention, the first length is greater than the second length. In another embodiment of the invention, the second length is greater than the first length.

In an embodiment of the invention, the body, first handgrip and second handgrip are fabricated from a common material. The common material is one of a fleece material, a flannel material.

An embodiment of the invention further comprises a method for fabricating an exercise prop. The method comprises the steps of:

providing three rectangular strips of material, wherein two first strips have a first length and one second strip has a second length, the one second strip having a first side and a second side, each of the three strips having a first end and a second end;

arranging the one strip having a second length in a first substantially flattened orientation;

attaching the first ends of the two first strips to the first side of the second strip, at a location removed from a free edge of the first end of the second strip, defining a first tail end of the second strip;

braiding the three strips to define a body portion of the exercise prop;

attaching the second ends of the two first strips to the first side of the second strip at a location removed from a free edge of the second end of the second strip, defining a second tail end of the second strip;

forming the first and second ends of the second strip into loops and affixing end edges of the first and second ends of the second strip to respective locations of the second strip remote from the respective first and second end edges.

In an embodiment of the method, the second length is greater than the first length. In an alternative embodiment of the method, the first length is greater than the second length.

In an embodiment of the invention, the method further comprises the step of:

prior to attaching the first ends of the two first strips to the second strip, folding each of the two first strips longitudinally.

In an embodiment of the invention, the step of folding each of the two first strips longitudinally further comprises the step of:

folding each first strip into two portions, widthwise, wherein a first width portion has a first width, and a second width portion has a second width approximately twice the first width.

In an embodiment of the invention, the method further comprises the step of:

prior to attaching the first ends of the two first strips, aligning the first two strips such that the first width portion of a first of the first strips is overlaid by the second width portion of a second of the first strips, and the second width portion of the first of the first strips overlays the first width portion of the second of the first strips.

In an embodiment of the invention, the method further comprises the step of:

prior to forming the first and second ends of the second strip into loops, folding each tail end longitudinally to align peripheral edges of each respective tail end, diagonally cutting each folded tail end, sewing together the aligned peripheral edges of each folded tail end to define a tube, leaving a gap at a location proximate a location where each tail end extends from a corresponding end of the body portion;

everting each tube end and pulling it through a corresponding gap.

Another embodiment of the invention comprises a method for fabricating an exercise prop, the method comprising the steps of:

providing at least three strips of material, wherein at least first and second strips have a first length and at least one third strip has a second length shorter than the first length, each of the strips having a first end and a second end;

affixing a first end of a first strip having a first length and a first end of the at least one third strip having a second length, to the second strip having a first length, at a location spaced apart from the first end of the second strip;

braiding the first, second and third strips to form a body;

affixing together second ends of the second and third strips to the first strip, at a location spaced apart from the second end of the first strip, leaving a free portion of the second strip at the first end thereof and a free portion of the first strip at a second end thereof;

forming the free portion of the second strip into a loop and affixing same to the body; and forming the free portion of the first strip into a loop and affixing same to the body.

DETAILED DESCRIPTION OF THE DRAWINGS

Figure 1:
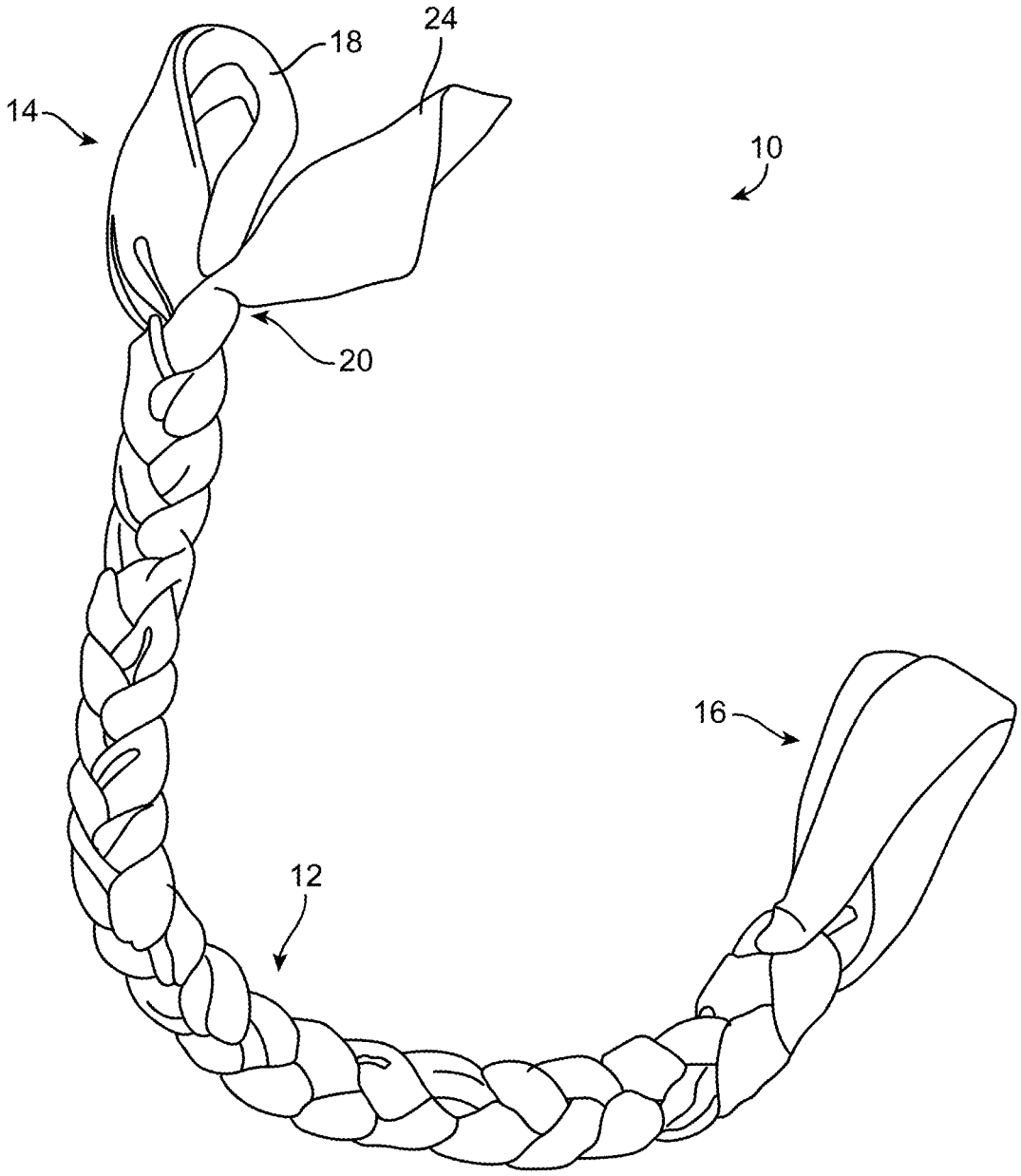
FIG. 1 is a plan view of an exercise prop according to an embodiment of the invention.

While this invention is susceptible of embodiment in many different forms, there are shown in the drawings and described in detail herein, specific embodiments, with the understanding that the present disclosure is to be considered as an exemplification of the principles of the invention and is not intended to limit the invention to the embodiment(s) illustrated.

The invention and accompanying drawings will now be discussed in reference to the numerals provided therein to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventors can be their own lexicographers. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f) or pre-AIA 35 U.S.C. § 112~6. Thus, the use of the words "function," "means" or "step" in the Detailed Description of the Invention or claims is not intended to somehow indicate a desire to invoke the special provisions of 35 U.S.C. § 112(f) or pre-AIA 35 U.S.C. § 112~6 to define the invention. To the contrary, if the provisions of 35 U.S.C. § 112(f) or pre-AIA 35 U.S.C. § 112~6 are sought to be invoked to define the inventions, the claims will specifically and expressly state the exact phrases "means for" or "step for" and the specific function (e.g., "means for roasting"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f) or pre-AIA 35 U.S.C. § 112~6. Moreover, even if the provisions of 35 U.S.C. § 112(f) or pre-AIA 35 U.S.C. § 112~6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and apparatus are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, apparatus and technologies to which the disclosed inventions may be applied. Thus, the full scope of the inventions is not limited to the examples that are described below.

Various aspects of the present invention may be described in terms of functional block components and various processing steps. Such functional blocks may be realized by any number of hardware or software components configured to perform the specified functions and achieve the various results.

Figure 2:
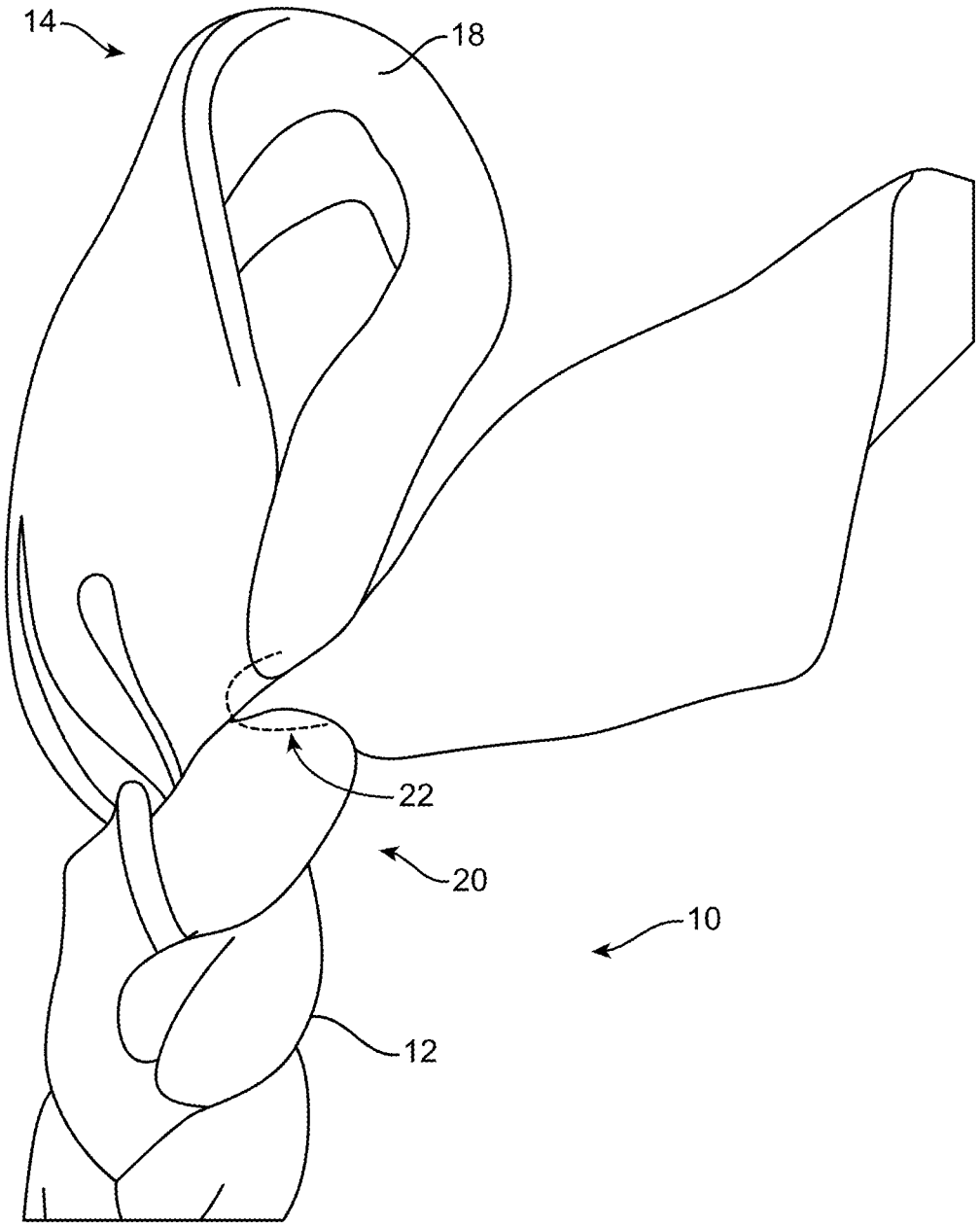
FIG. 2 is an enlarged plan view of the exercise prop of FIG. 1, illustrating details of a handgrip portion of the prop.

FIG. 1 is a plan view of an exercise prop 10 according to an embodiment of the invention. Prop 10 includes a body 12 and handgrips 14, 16, respectively. Body 12 is formed, in an embodiment of the invention, from three strips of material which are braided in a conventional basic three-strand braid. In an embodiment of the invention, all three strips are constructed of the same fabric material, which may be fleece, flannel, or any other natural and/or synthetic fabric material. In an alternative embodiment, the strips may be made of different materials, having different characteristics, such as softness, durability, stretchability, etc., as may be desired to meet the requirements of a particular implementation. FIG. 2 is an enlarged plan view of exercise prop 10 of FIG. 1, illustrating details of a handgrip 14 of the prop. In an embodiment of the invention, handgrip 14 is formed from an extended end portion of one of the strips of material forming body 12, which has been folded to form a loop 18, a bight 20 of which is permanently affixed to an end of body 12 by any suitable means, such as a stitch 22, staple or other fastening means. A tail 24 may be provided. Opposite handgrip 16 may be formed in a similar fashion.

Figure 3:
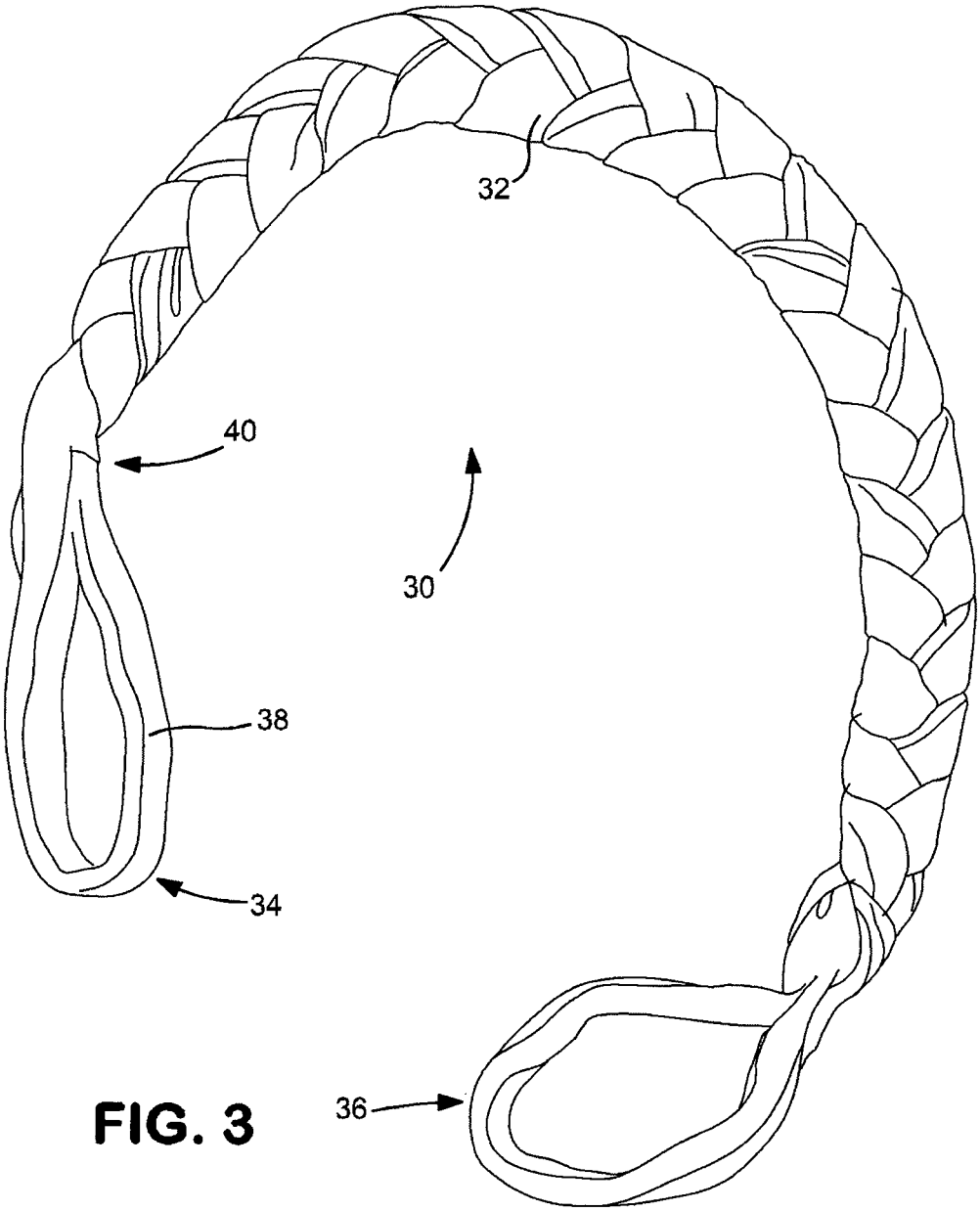
FIG. 3 is a plan view of an exercise prop according to another embodiment of the invention.
Figure 4:
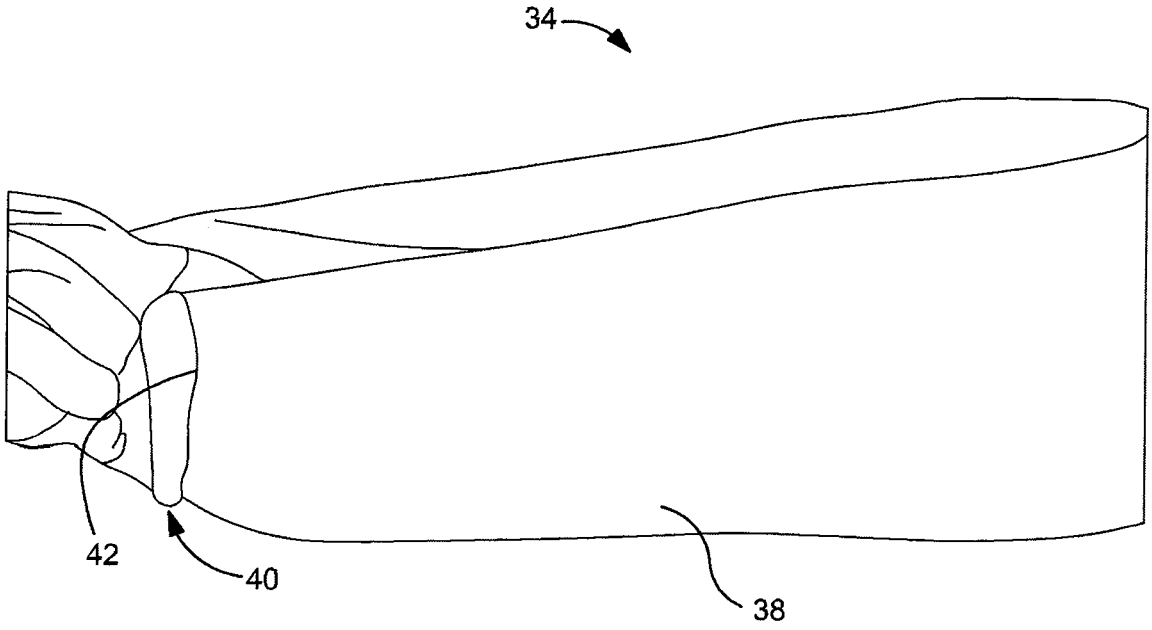
FIG. 4 is an enlarged plan view of the exercise prop of FIG. 3, illustrating details of a handgrip portion of the prop.

FIG. 3 is a plan view of an exercise prop 10 according to an embodiment of the invention. Prop 30 includes a body 32 and handgrips 34, 36, respectively. Body 32 is formed, in an embodiment of the invention, from three strips of material which are braided in a conventional basic three-strand braid. FIG. 4 is an enlarged plan view of exercise prop 30 of FIG. 3, illustrating details of a handgrip 34 of the prop. In an embodiment of the invention, handgrip 34 is formed from an extended end portion of one of the strips of material forming body 32, which has been folded to form a loop 38, a foreshortened bight 40 (more fully visible in FIG. 4) of which is permanently affixed to an end of body 32 by any suitable means, such as a stitch 42, staple or other fastening means. Opposite handgrip 36 may be formed in a similar fashion.

Figure 5:
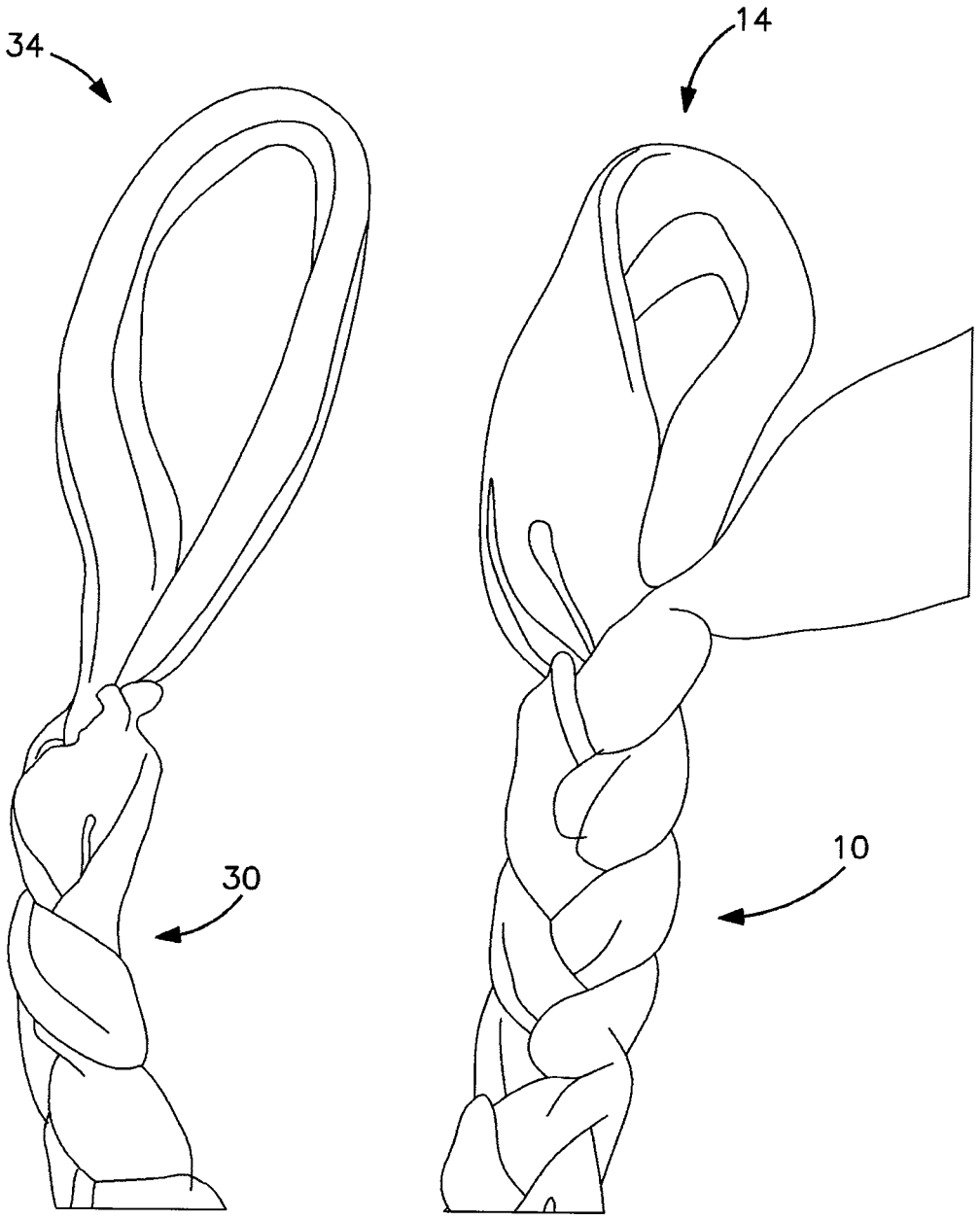
FIG. 5 is a side-by-side view of the handgrip regions of the props of the embodiments of FIGS. 1-2 and 3-4, respectively.

FIG. 5 is a side-by-side view of the handgrip regions 14, 34 of the props 10, 30 of the embodiments of FIGS. 1-2 and 3-4, respectively.

Figure 6:
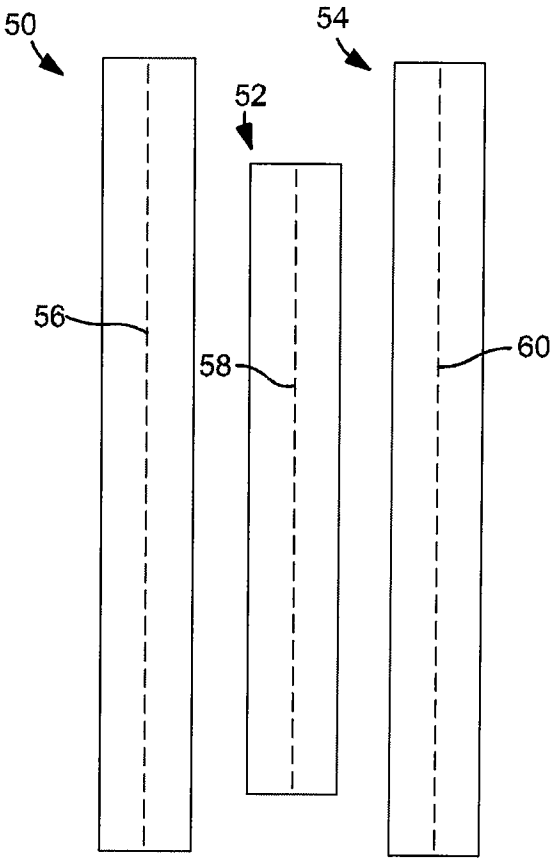
FIG. 6 is a plan view of the basic components for an exercise prop according to an embodiment of the invention.

FIG. 6 is a plan view of the basic components for an exercise prop according to an embodiment of the invention. In an embodiment of the invention, a prop, for example, prop 30 of FIGS. 3-4, is fabricated from three strips of fabric, e.g., strips 50, 52 and 54, which are preferably folded in half, e.g., along fold lines 56, 58, 60, respectively, prior to braiding. It is noted that, in a preferred embodiment, one of the strips, i.e., strip 52, is of shorter length than the other strips 50, 54.

Figure 7:
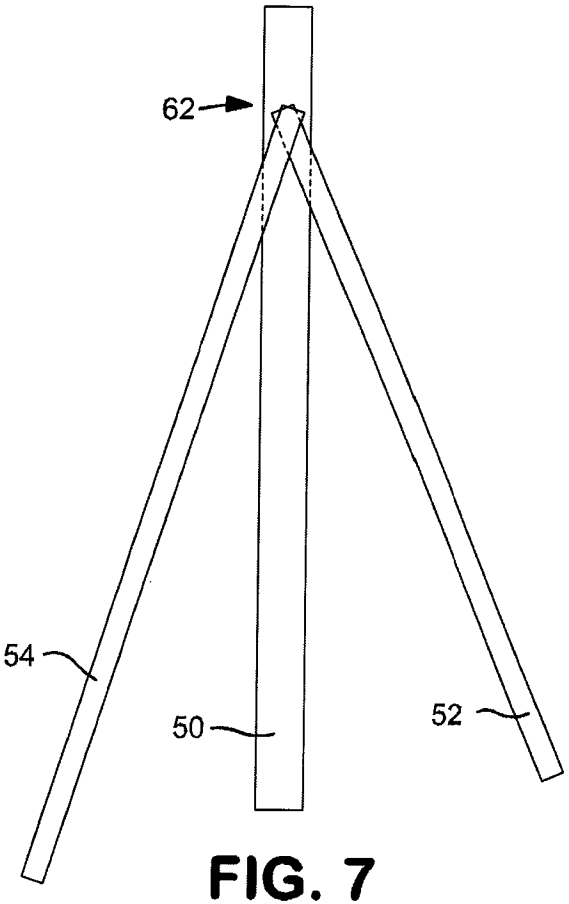
FIG. 7 is a plan view of a portion of the method for fabrication of an exercise prop according to an embodiment of the invention.

FIG. 7 is a plan view of a portion of the method for fabrication of an exercise prop according to an embodiment of the invention, in particular, prop 30 of FIGS. 3-4, and employing strips 50, 52, 54 of FIG. 6. First, strips 50, 52, 54 are all folded in half lengthwise, as previously described. Then, first ends (the upper ends in FIG. 7) of the short strip and one of the longer strips, e.g., strips 52, 54, are affixed to a first end of the remaining longer strip 50, at a location 62, spaced a distance from an extreme end edge of strip 50, to define a free end which will be used to form handgrip 34. A tack stitch or any other suitable means may be employed, such as adhesive, staple, etc.

Once strips 52, 54 are affixed to strip 50 as described, strips 50, 52, 54 are woven into a braid, using any suitable conventional three-strand braiding technique. Upon completion of the braid, second ends of strips 50, 52, 54 (the lower ends in FIG. 7) are affixed together, in a manner as describe above. The respective hand grips are then formed by folding the extra fabric beyond each tack in half lengthwise (e.g., if the fold has come undone during the braiding process, stitching lengthwise, pulling fabric through the hole formed by stitching. The handgrips are formed by looping the free ends of the longer strips, and stitching the extreme free ends on, at or near the end of the braid, forming the loop.

Figure 8:
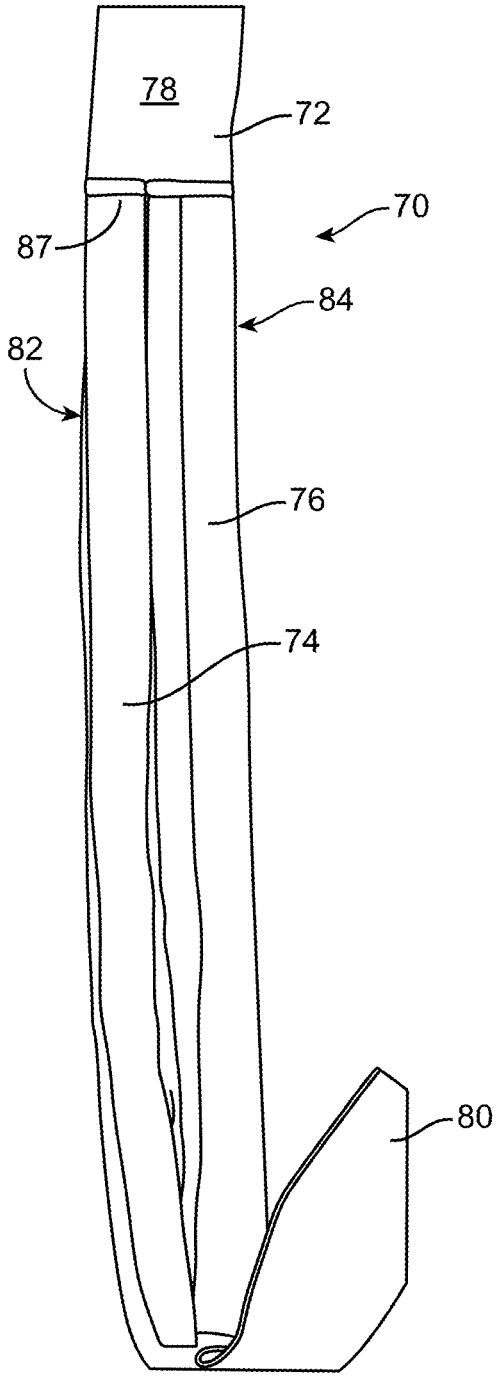
FIG. 8 is an illustration of a step in a method for constructing an exercise prop according to an embodiment of the invention.

FIG. 8 is an illustration of a first step in a method for constructing an exercise prop according to an embodiment of the invention. In this embodiment, an exercise prop precursor 70 comprises a long strip 72 and short strips 74, 76. In an embodiment of the invention, long strip 72 may be 68 inches in length, while short strips 74, 76 may be 37 inches in length. The foregoing dimensions are provided merely by way of example, and the invention is not limited thereto, as the lengths, and widths of the strips may be varied as desired to meet the requirements of a particular version. For example, while in the illustrated and described embodiment, each of the strips may have a width of 5 inches; in an alternative embodiment, the strips may be proportionally shorted and narrowed, for example to yield an exercise prop suitable for children or smaller adults, or lengthened for larger adults.

According to the method of FIG. 8, long strip 72 is laid flat on a surface, having a first end 78 and a second end 80. A first short strip 74 is initially folded lengthwise, e.g., along longitudinal fold 82. In an embodiment, fold 82 divides a width of short strip 74 into one-third (facing the viewer) and two-thirds (completely in the background in FIG. 8) portions. A first end 87 of short strip 74 is temporarily affixed in place, e.g., via pin(s) to long strip 72 a predetermined distance from the end edge of end 78. Second short strip 76 is folded lengthwise, e.g., along longitudinal fold 84, such that fold 84 divides a width of strip 76 into two-thirds (partially in the background) and one-third (in the foreground in FIG. 8) portions, and laid atop strip 72 and partially over strip 74, specifically the right half of the two-thirds portion of 74, as seen in FIG. 8) and temporarily fixed in place as previously described, such that the free edge of the one-third portion of strip 74 abuts the free edge of the two-thirds portion of strip 76, with those portions immediately juxtaposed to a surface of strip 72. Thus, the free edge of the one-third portion of strip 74 generally abuts the free edge of the two-thirds portion of the strip 76. In an embodiment of the invention, the distance between the free end of strip 72, and the location of attachment of strips 74, 76 to strip 72 is sufficient to allow the free end of 72 to be turned back on itself to form a loop, as described in further detail herein. In an embodiment of the invention, the distance will be 16 inches; this length may vary depending on the size of the prop being made for a child, smaller adult or larger adult. A similar length of strip 72, beyond the free ends of strips 74, 76, will be provided to enable the formation of a loop at end 80 of strip 72. Strips 74, 76 are then permanently affixed to strip 72 by any suitable means, such as via straight stitches, a zig-zag stitch, or a combination thereof.

Figure 9:
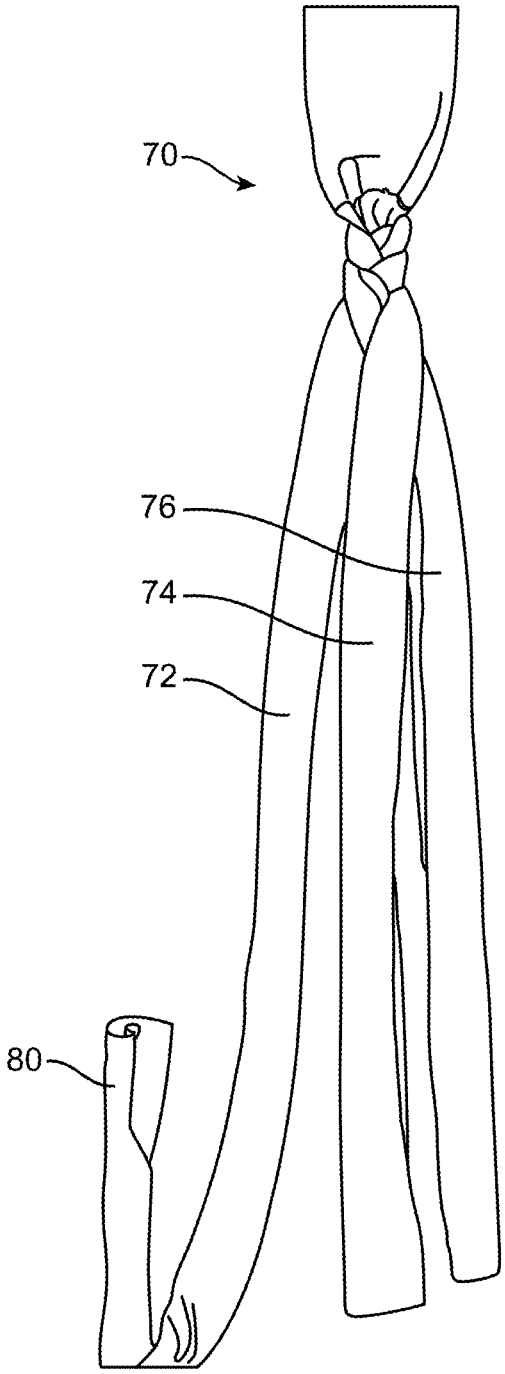
FIG. 9 is an illustration of a further step in the method according to the embodiment of FIG. 8.
Figure 10:
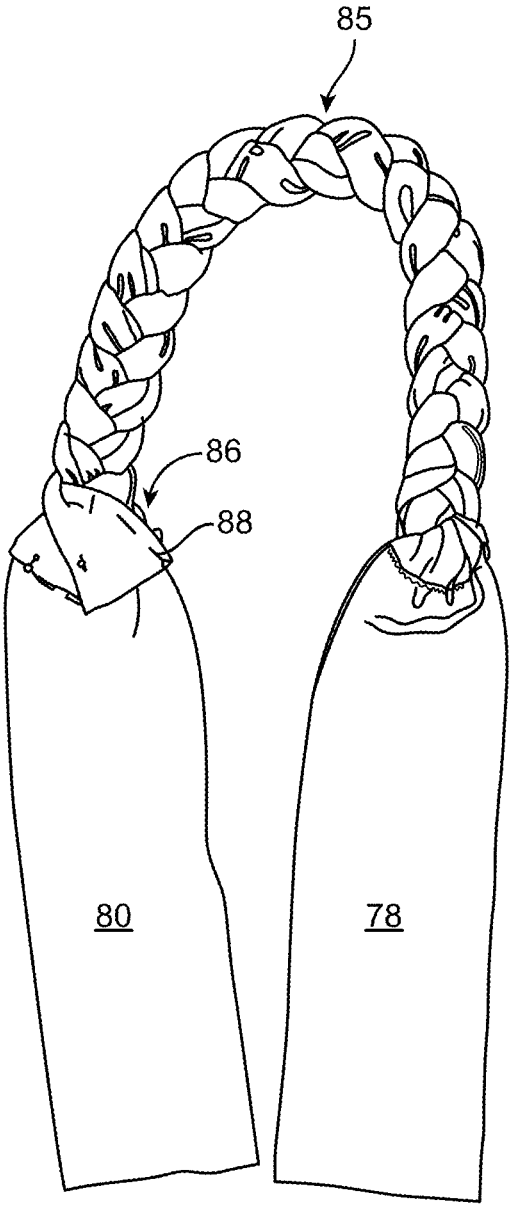
FIG. 10 is an illustration of a third step in the method according to the embodiment of FIG. 8.
Figure 11:
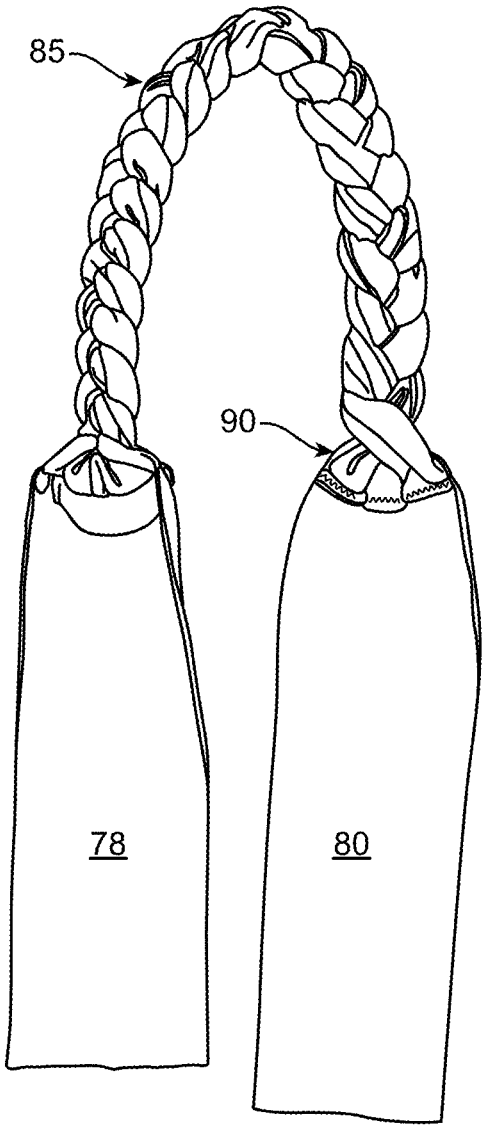
FIG. 11 is an illustration of a further step in the method according to the embodiment of FIG. 8.
Figure 12:
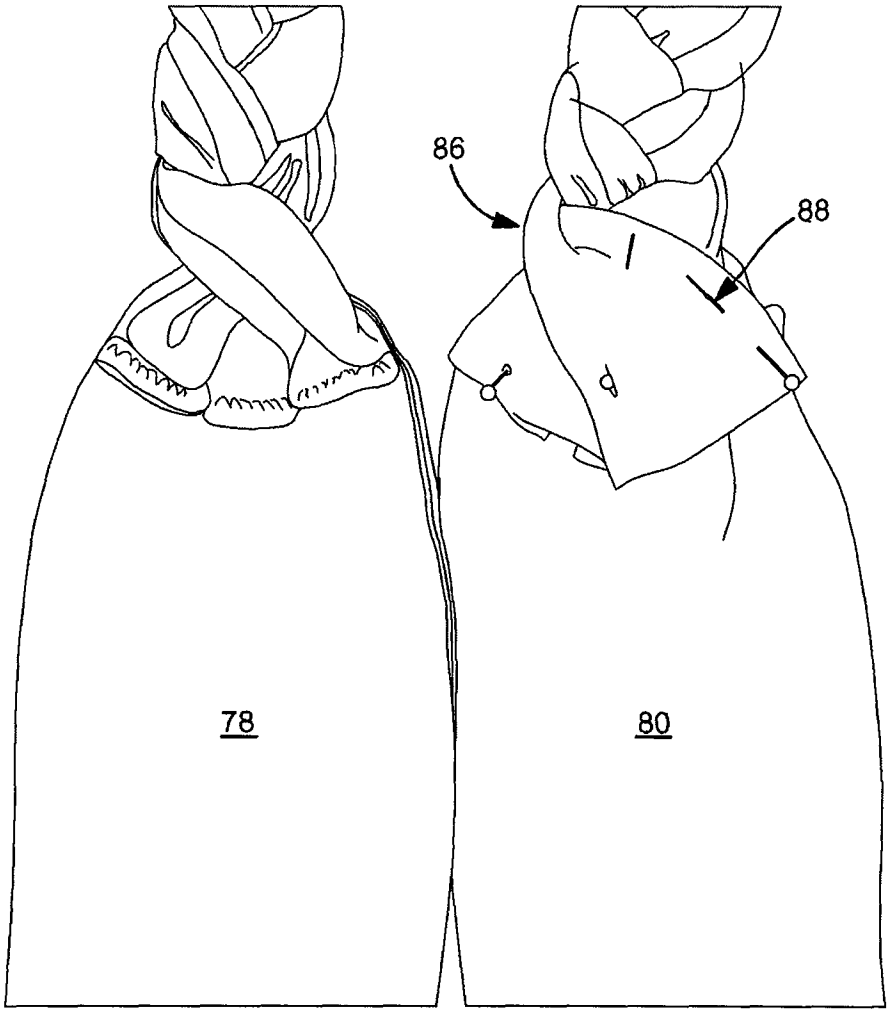
FIG. 12 is an enlargement of a portion of FIG. 10.

FIG. 9 is an illustration of a further step in the method according to the embodiment of FIG. 8. Each of strips 72, 74, 76 is further folded or rolled, so as to have a width or diameter approximately one-third the original width of each strip. In an embodiment of the invention, means, such as manual pressure or removable metal or plastic clips or frames, may be employed to retain each strip in its rolled or folded configuration, until braiding has been completed. Once suitably reduced in diameter/width, strips 72, 74, 76 are braided in a conventional three-strand braid. FIG. 10 is an illustration of a further step in the method according to the embodiment of FIG. 8. Once braiding of strips 72, 74, 76 has been completed, body 84 is formed. The previously-free ends of strips 74, 76 are pinned at 86 to end 80, e.g., via one or more pins 88, as shown in enlarged detail in FIG. 12. Then, the pinned ends are stitched, again, for example via zig-zag and straight stitching at 90 (FIG. 11), and any excess is trimmed away.

Figure 13:
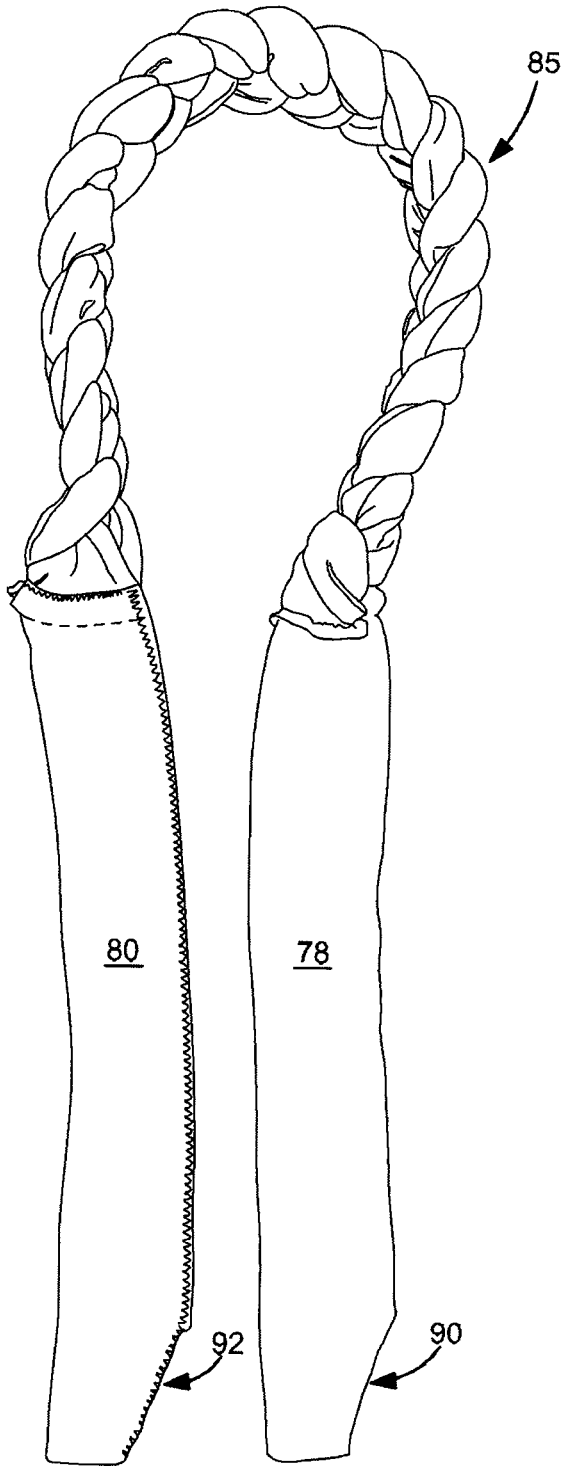
FIG. 13 is an illustration of a further step in the method according to the embodiment of FIG. 8.
Figure 14:
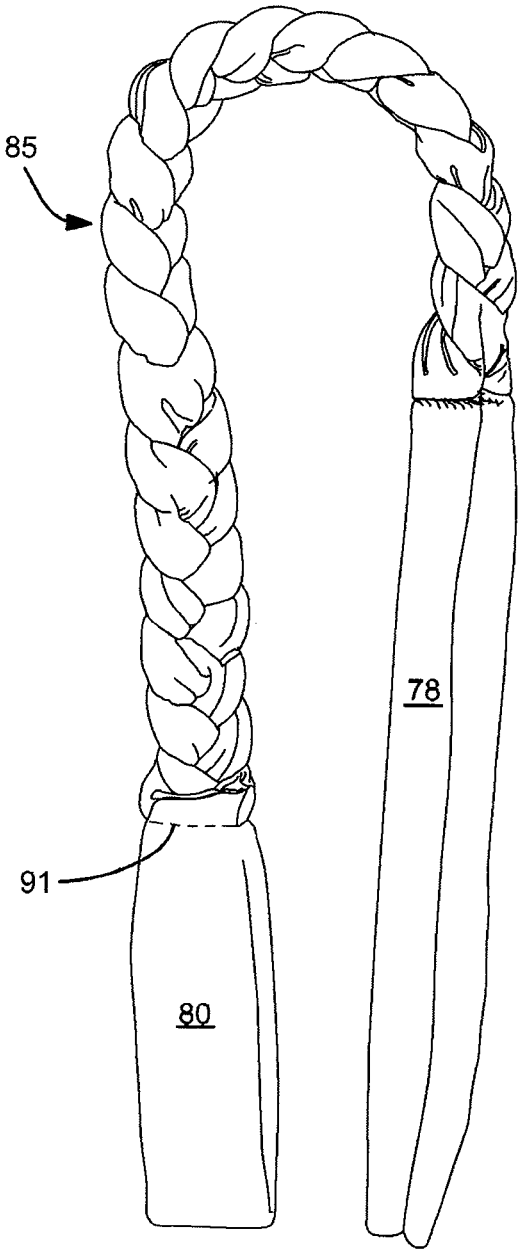
FIG. 14 is an illustration of a further step in the method according to the embodiment of FIG. 8.
Figure 16:
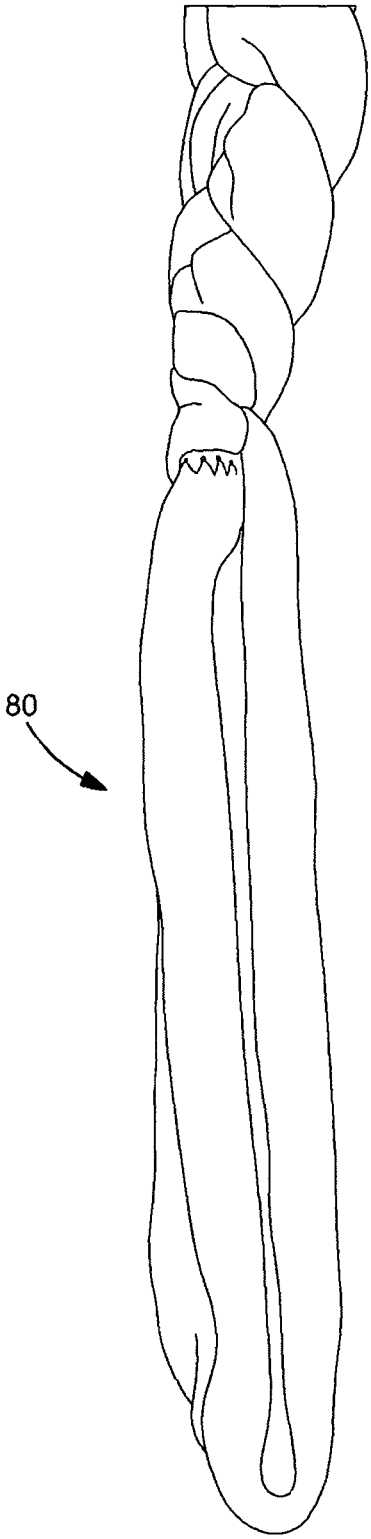
FIG. 16 is an illustration of a further step in the method according to the embodiment of FIG. 8.
Figure 15:
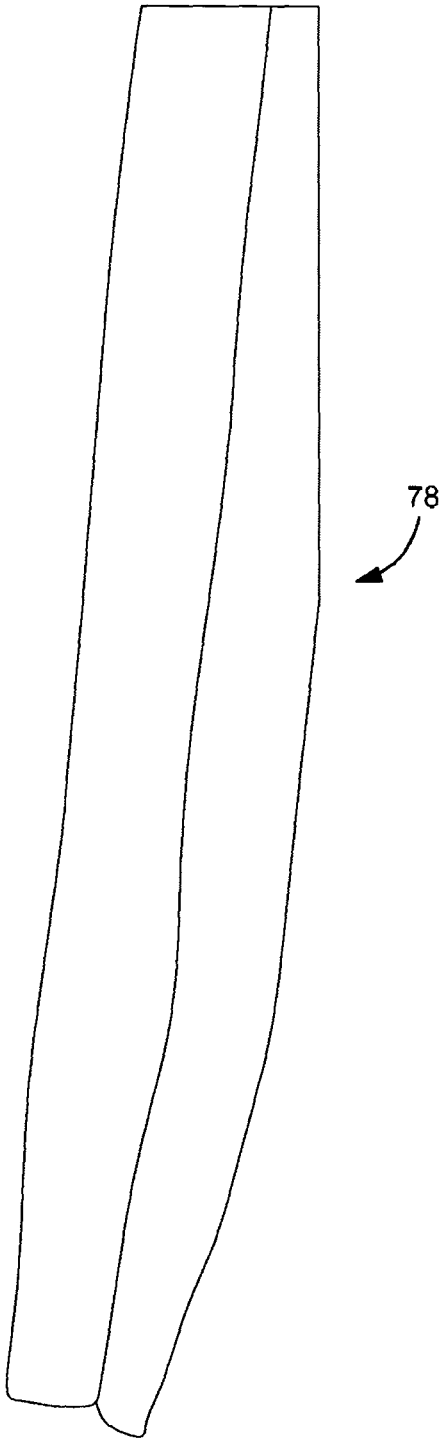
FIG. 15 is an illustration of a further step in the method according to the embodiment of FIG. 8.

FIG. 13 is an illustration of a further step in the method according to the embodiment of FIG. 8. Ends of strips 78, 80 are folded in half longitudinally, such that the lateral edges of each of the ends of strips 78, 80 are juxtaposed. Where the respective ends of strips 74, 76 meet strip 72, a stitch is then placed substantially across the folded-over portions of each of the free ends of strips 72, 74, 76, leaving a small gap, the purpose of which will be described hereinafter. The ends of strips 78, 80 are then cut diagonally at 90, 92. The juxtaposed edges of the respective folded ends of strips 78, 80 are then stitched together, e.g., via a zig-zag stitch, to form a tube end, as shown on the right of FIG. 14, at end 78, and in an enlarged view in FIG. 15. Thereafter, each of ends 78, 80 is everted, and pulled through the respective gaps mentioned previously, and then each of ends 78, 80 is turned on itself and stitched 91 to a corresponding end of body 85, as represented by the left side of FIG. 14 at end 80, and shown in enlarged view in FIG. 16.

In a preferred embodiment, the props of the present invention are fabricated from Blizzard Fleece™ fabric (although a slightly lighter weight fleece or other, preferably stretchable, fabric may be used, as desired), which allows props 10, 30 to be stretched slightly. The braid is easier to grip or hold during exercise because of the texture of the braid, including the lengthwise fold, which increases the texture of the fabric. The end loops, preferably, should be large enough to allow a user to place a foot therein as well. The loops at each end of the braid allow for hands to reach through to hold the braided body with ease as well as to allow the user to make individual adjustments as to length for different exercises. The length of the body of the device may be varied as desired, but it is contemplated that the body will have a length of around 2-3 feet, to accommodate users having customary body sizes and dimensions.

Although the invention has been described with reference to the above examples, it will be understood that many modifications and variations are contemplated within the true spirit and scope of the embodiments of the invention as disclosed herein. Many modifications and other embodiments of the invention set forth herein will come to mind to one skilled in the art to which the invention pertains having the benefit of the teachings presented in the foregoing descriptions and the associated drawings. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

What is claimed is:

1. A method for fabricating an exercise prop, the method comprising the steps of:

providing three rectangular strips of material, wherein first and second strips have a first length and a third strip has a second length, the the third strip having a first side and a second side, each of the three strips having a first end and a second end;

arranging the third strip in a first substantially flattened orientation;

attaching the first ends of the first and second strips to the first side of the third strip, at a location removed from a free edge of the first end of the third strip, defining a first tail end of the third strip;

braiding the three strips to define a body portion of the exercise prop;

attaching the second ends of the first and second strips to the first side of the third strip at a location removed from a free edge of the second end of the third strip, defining a second tail end of the third strip;

forming the first and second ends of the third strip into loops and affixing end edges of the first and second ends of the third strip to respective locations of the second strip remote from the respective first and second end edges.

2. The method according to claim 1, wherein the second length is greater than the first length.

3. The method according to claim 1, wherein the first length is greater than the second length.

4. The method according to claim 1, further comprising the step of:

prior to attaching the first ends of the first and strips to the third strip, folding each of the first and second strips longitudinally.

5. The method according to claim 4, wherein the step of folding each of the first and second strips longitudinally further comprises the step of:

folding each of the first and second strips into two portions, widthwise, wherein a first width portion has a first width, and a second width portion has a second width approximately twice the first width.

6. The method according to claim 5, further comprising the step of:

prior to attaching the first ends of the first and second strips, aligning the first and second strips such that the first width portion of the first strip is overlaid by the second width portion of the second strip, and the second width portion of the first strip overlays the first width portion of the second strip.

7. The method according to claim 1, further comprising the step of:

prior to forming the first and second ends of the third strip into loops, folding each tail end longitudinally to align peripheral edges of each respective tail end, diagonally cutting each folded tail end, sewing together the aligned peripheral edges of each folded tail end to define a tube, leaving a gap at a location proximate a location where each tail end extends from a corresponding end of the body portion;

everting each tube end and pulling it through a corresponding gap.

8. A method for making the exercise prop, the method comprising the steps of:

providing three rectangular strips of material, wherein first and second strips have a first length and a third strip has a second length, the third strip having a first side and a second side, each of the three strips having a first end and a second end;

arranging the third strip in a first substantially flattened orientation:

folding each of the first and second strips longitudinally;

attaching the first ends of the first and second strips to the first side of the third strip, at a location removed from a free edge of the first end of the third strip, defining a first tall end of the third strip;

braiding the three strips to define a body portion of the exercise prop;

attaching the second ends of the first and second strips to the first side of the third strip at a location removed from a free edge of the second end of the third strip, defining a second tall end of the third strip;

forming the first and second ends of the third strip into loops and affixing end edges of the first and second ends of the third strip to respective locations of the second strip remote from the respective first and second end edges.

9. The method according to claim 8, wherein the second length is greater than the first length.

10. The method according to claim 9, wherein the step of folding each of the first and second strips longitudinally further comprises the step of:

folding each of the first and second strips into two portions, widthwise, wherein a first width portion has a first width, and a second width portion has a second width approximately twice the first width.

11. The method according to claim 10, further comprising the step of:

prior to attaching the first ends of the first and second strips, aligning the first and second strips such that the first width portion of the first strip is overlaid by the second width portion of the second strip and the second width portion of the first strip overlays the first width portion of the second strip.

12. The method according to claim 8, further comprising the step of:

prior to forming the first and second ends of the third strip into loops, folding each tail end longitudinally to align peripheral edges of each respective tail end, diagonally cutting each folded tail end, sewing together the aligned peripheral edges of each folded tail end to define a tube, leaving a gap at a location proximate a location where each tail end extends from a corresponding end of the body portion;

everting each tube end and pulling it through a corresponding gap.

* * * * *